US007309033B2

(12) United States Patent
Dallmeyer

(10) Patent No.: US 7,309,033 B2
(45) **Date of Patent: *Dec. 18, 2007**

(54) DEEP POCKET SEAT ASSEMBLY IN MODULAR FUEL INJECTOR WITH FUEL FILTER MOUNTED TO SPRING BIAS ADJUSTING TUBE AND METHODS

(75) Inventor: Michael Dallmeyer, Newport News, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/195,151

(22) Filed: Aug. 2, 2005

(65) Prior Publication Data

US 2006/0071101 A1 Apr. 6, 2006

(51) Int. Cl.
*B05B 1/30* (2006.01)

(52) U.S. Cl. ..... 239/585.1; 239/585.2; 239/585.3; 239/585.4; 239/585.5; 239/900; 251/129.21

(58) Field of Classification Search ..... 239/585.1, 239/585.3, 585.4, 585.5, 900; 251/129.15, 251/129.16, 129.19, 129.21
See application file for complete search history.

(56) References Cited

U.S. PATENT DOCUMENTS 5,769,391 A * 6/1998 Noller et al. ..... 251/129.21
6,264,112 B1 * 7/2001 Landschoot et al. ..... 239/5
6,390,067 B1 5/2002 Haltiner et al.
6,499,668 B2 * 12/2002 Dallmeyer et al. ..... 239/5
6,648,247 B2 * 11/2003 McFarland ..... 239/585.1
6,676,044 B2 * 1/2004 Dallmeyer et al. ..... 239/585.1
6,719,223 B2 * 4/2004 Yukinawa et al. ..... 239/584
7,021,566 B2 * 4/2006 Dallmeyer et al. ..... 239/533.3
2002/0047054 A1 4/2002 Dallmeyer
2006/0071102 A1 * 4/2006 Dallmeyer ..... 239/585.1

FOREIGN PATENT DOCUMENTS

WO WO 2005/033501 A 4/2005

OTHER PUBLICATIONS

International Search Report, Date Completed: Oct. 27, 2005 for International Appl. No. : PCT/US2005/027488.

* cited by examiner

*Primary Examiner*—Dinh Q. Nguyen

(57) ABSTRACT

A fuel injector and various methods relating to the assembly of the fuel injector. The fuel injector includes a power group subassembly and a valve group subassembly having a respectively connected first and second connector portions. The power group subassembly includes an electromagnetic coil, a housing, at least one terminal, and at least one overmold formed over the coil and housing. The valve group subassembly insertable within the overmold includes a tube assembly having an inlet tube and a filter assembly. A pole piece couples the inlet tube to one end of a non-magnetic shell having a valve body coupled to the opposite end. An axially displaceable armature assembly confronts the pole piece and is adjustably biased by a member engaged with an adjusting tube with a filter assembly mounted thereon. The seat assembly includes a flow portion and a securement portion having respective first and second axial lengths at least equal to one another.

36 Claims, 14 Drawing Sheets

DEEP POCKET SEAT ASSEMBLY IN MODULAR FUEL INJECTOR WITH FUEL FILTER MOUNTED TO SPRING BIAS ADJUSTING TUBE AND METHODS

BACKGROUND OF THE INVENTION

It is believed that examples of known fuel injection systems use an injector to dispense a quantity of fuel that is to be combusted in an internal combustion engine. It is also believed that the quantity of fuel that is dispensed is varied in accordance with a number of engine parameters such as engine speed, engine load, engine emissions, etc.

It is believed that examples of known electronic fuel injection systems monitor at least one of the engine parameters and electrically operate the injector to dispense the fuel. It is believed that examples of known injectors use electromagnetic coils, piezoelectric elements, or magnetostrictive materials to actuate a valve.

It is believed that examples of known valves for injectors include a closure member that is movable with respect to a seat. Fuel flow through the injector is believed to be prohibited when the closure member sealingly contacts the seat, and fuel flow through the injector is believed to be permitted when the closure member is separated from the seat.

It is believed that examples of known injectors include a spring providing a force biasing the closure member toward the seat. It is also believed that this biasing force is adjustable in order to set the dynamic properties of the closure member movement with respect to the seat.

It is further believed that examples of known injectors include a filter for separating particles from the fuel flow, and include a seal at a connection of the injector to a fuel source.

It is believed that such examples of the known injectors have a number of disadvantages.

It is believed that examples of known injectors must be assembled entirely in an environment that is substantially free of contaminants. It is also believed that examples of known injectors can only be tested after final assembly has been completed.

SUMMARY OF THE INVENTION

The present invention provides for, in one aspect, a fuel injector for use with an internal combustion engine. In a first preferred embodiment, the fuel injector includes an independently testable power group subassembly connected with an independently testable valve group subassembly so as to form a single unit. The power group subassembly has a first connector portion and includes an electromagnetic coil, a housing surrounding at least a portion of the coil, at least one terminal electrically coupled to the coil to supply electrical power to the coil, and at least one overmold formed over at least a portion of the coil and housing. The overmold has a first overmold end and a second overmold end opposite the first overmold end. The overmold also defines an interior surface. The valve group subassembly has a second connector portion and includes a tube assembly having at least a portion engaged with the interior surface of the overmold. The tube assembly has an outer surface and a longitudinal axis extending between a first tube end and a second tube end. The tube assembly includes an inlet tube having a first inlet tube end and a second inlet tube end. The fuel injector and valve group subassembly further includes a filter assembly having a filter element substantially disposed inside the inlet tube. A non-magnetic shell extends axially along the longitudinal axis and has a first shell end and a second shell end. A pole piece having at least a first portion connected to the inlet tube and a second portion connected to the first shell end couples the first shell end to the inlet tube. A valve body is coupled to the second shell end, and an armature assembly is disposed within the tube assembly. The armature assembly is displaceable along the longitudinal axis upon supplying energy to the electromagnetic coil and the armature assembly has a first armature end confronting the pole piece and a second armature end. The first armature end has a ferromagnetic portion and the second armature end has a sealing portion. The armature assembly further defines a through bore and at least one aperture in communication with the through bore. The first connector portion is preferably fixedly connected to the second connector portion such that the at least a portion of the armature assembly is surrounded by the electromagnetic coil. Also included is a member disposed and configured to apply a biasing force against the armature assembly toward the second tube end. The filter assembly engages an adjusting tube disposed within the tube assembly proximate the second tube end to adjust the biasing force. The adjusting tube is disposed within the tube assembly proximate the second tube end. The valve group further includes a seat assembly disposed in the tube assembly proximate the second tube end such that at least a portion of the seat assembly is disposed within the valve body. The seat assembly includes a flow portion extending along the longitudinal axis between a first surface and a second surface at a first length. The flow portion has at least one orifice defining a central axis and through which fuel flows into the internal combustion engine. The seat assembly further includes a securement portion having an outer surface, the securement portion extends distally along the longitudinal axis from the second surface at a second length at least as long as the first length.

In yet another aspect, the present invention provides for a method of assembling a fuel injector having an independently testable power group subassembly connected to an independently testable valve group subassembly so as to form a single unit for use with an internal combustion engine. The method of assembly includes providing a power group subassembly and providing a valve group subassembly that includes a tube assembly having a longitudinal axis extending between a first tube end and a second tube end. The tube assembly has an inlet tube including a first inlet tube end and a second inlet tube end, and a seat assembly is disposed proximate the second tube end. The tube assembly also includes an armature assembly and a resilient member. The resilient member biases the armature assembly toward the second tube end. The method further includes providing an adjusting tube and a filter assembly disposed within the inlet tube. The filter assembly can be disposed in a portion of the adjusting tube. The method further includes engaging the resilient member with another portion of the adjusting tube and inserting a seat assembly into the tube assembly. The seat assembly includes a flow portion having a first surface and a second surface defining a seat orifice, an orifice disk fixed to the second surface in a fixed spatial orientation with respect to the flow portion, and a securement portion extending distally from the second surface. The method also includes welding a portion of the securement portion to the tube assembly such that the flow portion and the fixed spatial orientation with respect to the orifice disk are maintained within a tolerance of 0.5%. The method also includes coupling the valve group and the power group subassemblies and welding at least a portion of the power group subassembly to at least a portion of the valve group subassembly to assemble the fuel injector.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention.

DETAILED DESCRIPTION OF THE PREFERRED EMBODIMENTS

Figure 1:
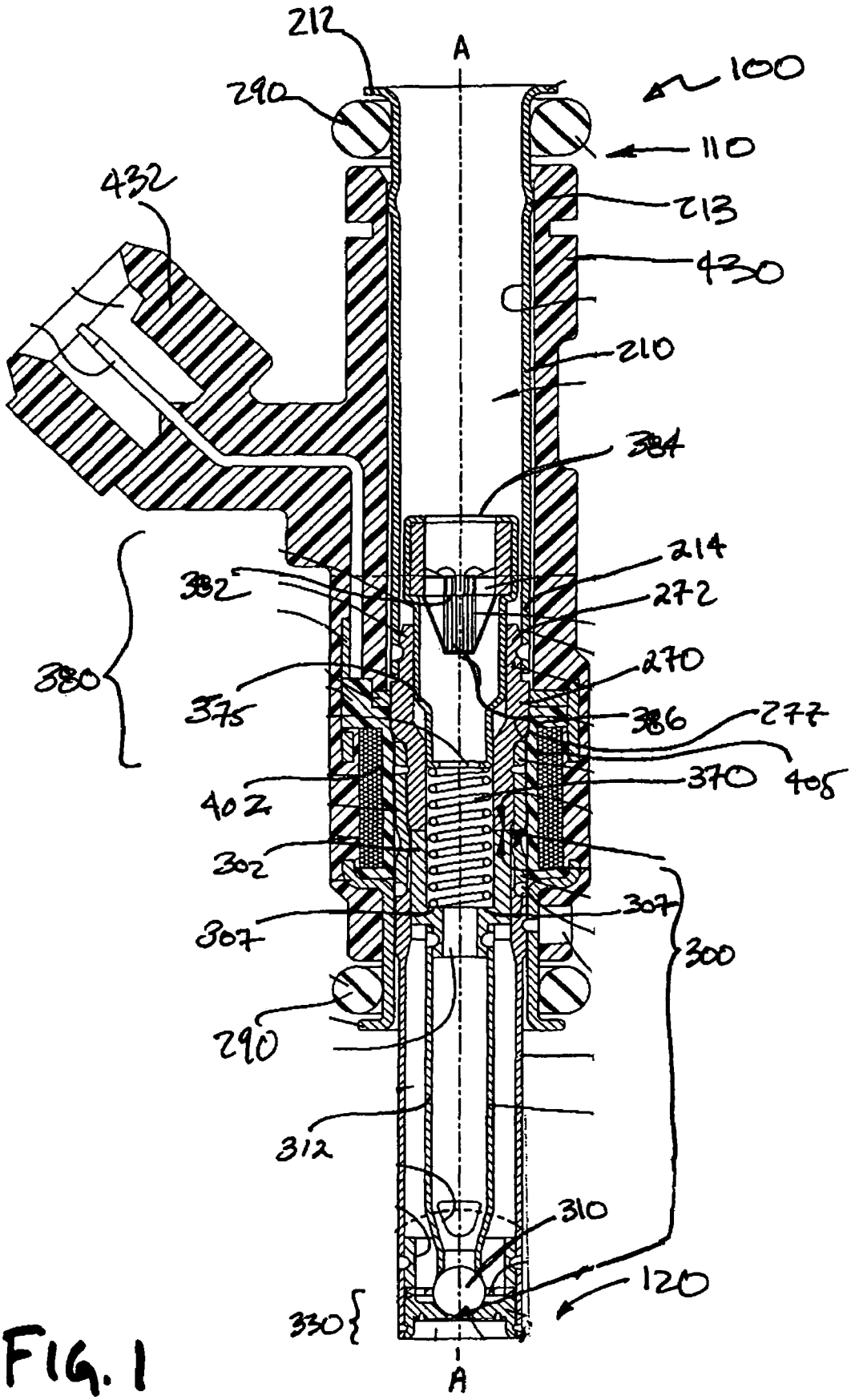
FIG. 1 is a cross-sectional view of a first preferred embodiment of a fuel injector.

Shown in FIGS. 1 and 1A are preferred embodiments of a solenoid actuated fuel injector 100 for dispensing a quantity of fuel that is to be combusted in an internal combustion engine (not shown). The fuel injector 100 extends along a longitudinal axis A--A between a first injector end 110 and a second injector end 120, and includes a valve group subassembly 200, shown in FIG. 2, and a power group subassembly 400, shown in FIG. 5. The valve group subassembly 200 performs fluid handling functions, e.g., defining a fuel flow path and prohibiting fuel flow through the injector 100. The power group subassembly 400 performs electrical functions, e.g., converting electrical signals to a driving force for permitting fuel flow through the injector 100.

Figure 2:
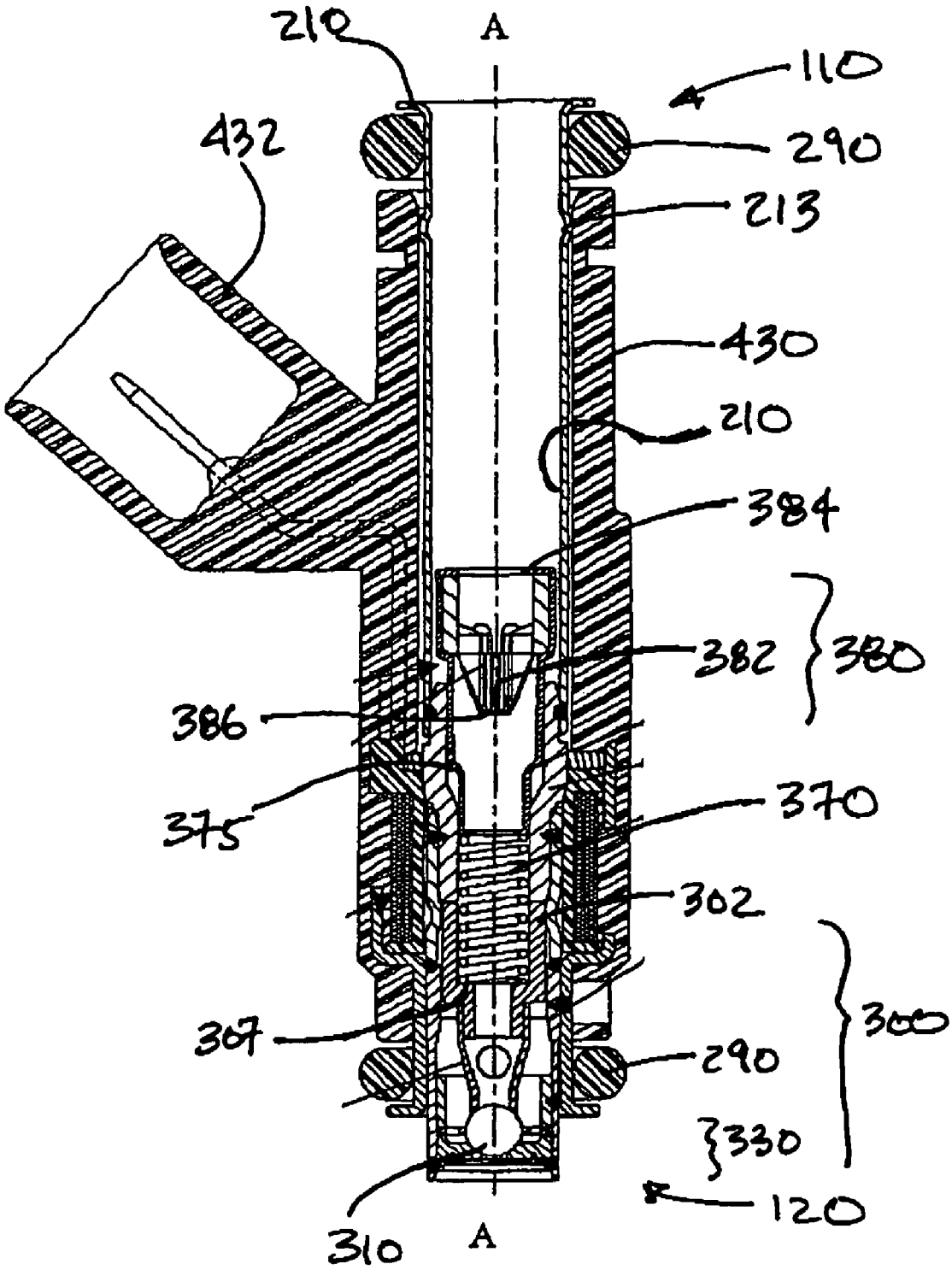
FIG. 2 is a cross-sectional view of another preferred embodiment of a fuel injector.

Referring to FIGS. 1 and 1A and shown specifically in FIG. 2 are various preferred embodiments of the valve group subassembly 200, which includes at least a tube assembly 202 extending along the longitudinal axis A-A between a first tube assembly end 204 and a second tube assembly end 206. The tube assembly 202 includes at least an inlet tube 210, a non-magnetic shell 230, and a valve body 250. The inlet tube 210 has a first inlet tube end 212 and a second inlet tube end 214 connected to a first shell end 232 of the non-magnetic shell 230. A second shell end 234 of the non-magnetic shell 230 is connected to a first valve body end 252 of the valve body 250 opposite the second valve body end 254. The inlet tube 210 can be formed preferably by a deep drawing process or by a rolling operation. The inlet tube 210 can also include a projection 213, shown in FIG. 2, for facilitating an interference fit with the power group subassembly 400, preferably with an overmold 430. A pole piece 270 can be integrally formed at the second inlet tube end 214 of the inlet tube 210, or as shown in FIGS. 1, 1A and 2, a pole piece 270 can be preferably formed separately and connected to second inlet tube end 214 at a first portion 272 of pole piece 270. A second portion 274 of the pole piece 270, integral or separate from the inlet tube 210, can be connected to the first shell end 232 of the non-magnetic shell 230. More specifically, the second portion 274 of the pole piece can engage an interior surface 231 of the non-magnetic shell 230. The non-magnetic shell 230 can include non-magnetic stainless steel, e.g., 300 series stainless steels, or other materials that have similar structural and magnetic properties. The inlet tube 210, pole piece 270, non-magnetic shell 230, and valve body 250 can be dimensioned and configured so as to have a generally constant outer diameter extending between the first tube assembly end 204 and second tube assembly end 206. As used herein, the term "generally,""approximately," or "about" indicates an acceptable level of tolerance that would still permit the preferred embodiments of the assembled fuel injector to meter fuel. Preferably the inlet tube 210 and non-magnetic shell 230 are non-magnetic 305 stainless steel, and the pole piece is ferromagnetic 430 stainless steel.

Figure 2A:
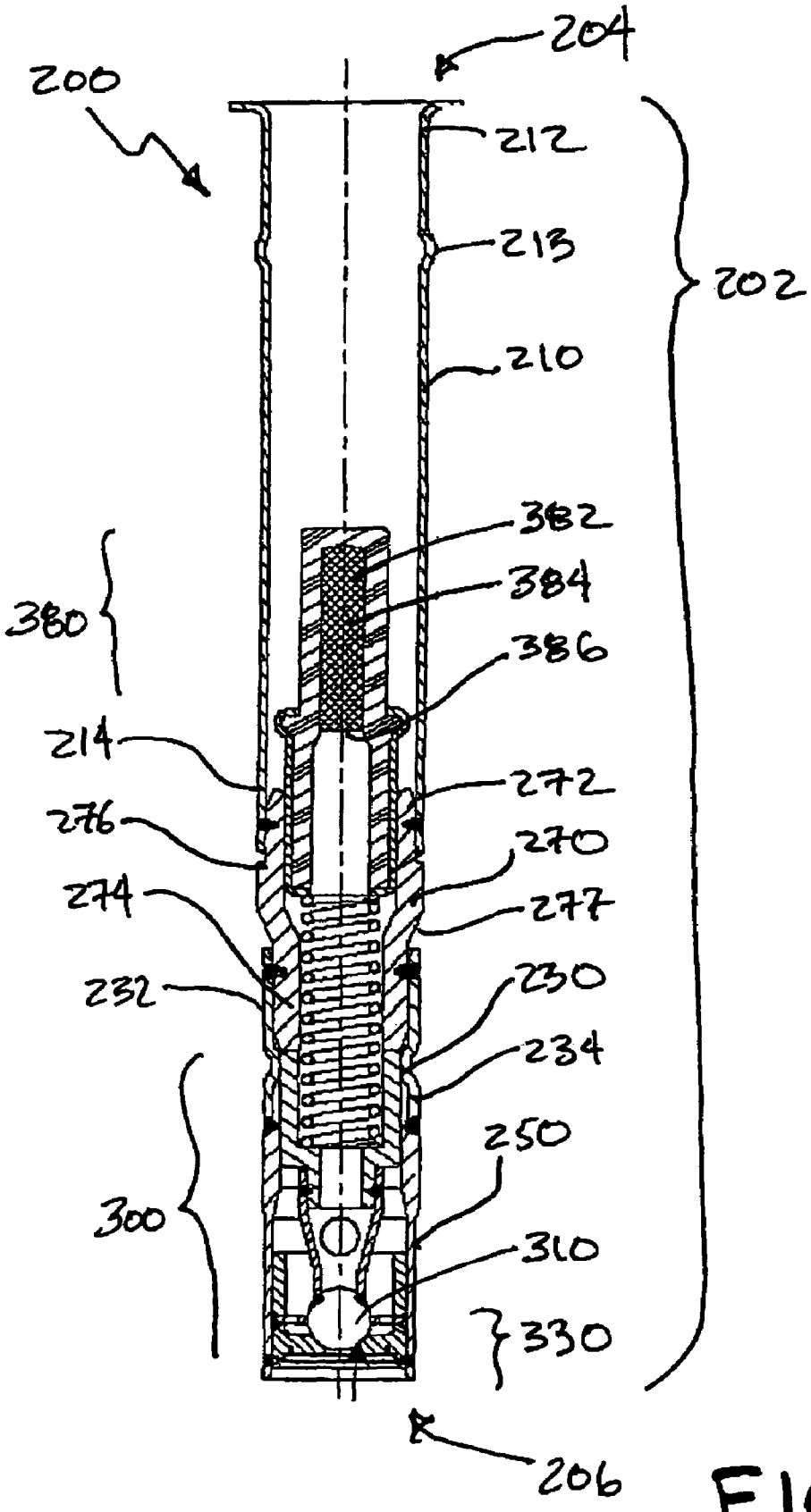
FIG. 2A is a cross-sectional view of a preferred valve group subassembly of a fuel injector.
Figure 2B:
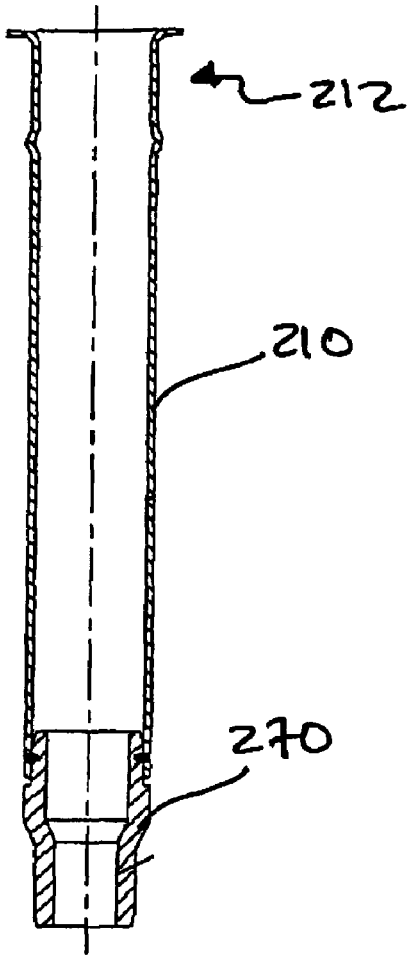
FIGS. 2B-2C are cross-sectional views of views of various inlet tube assemblies usable in the fuel injector illustrated in FIGS. 1 and 1A.
Figure 2C:
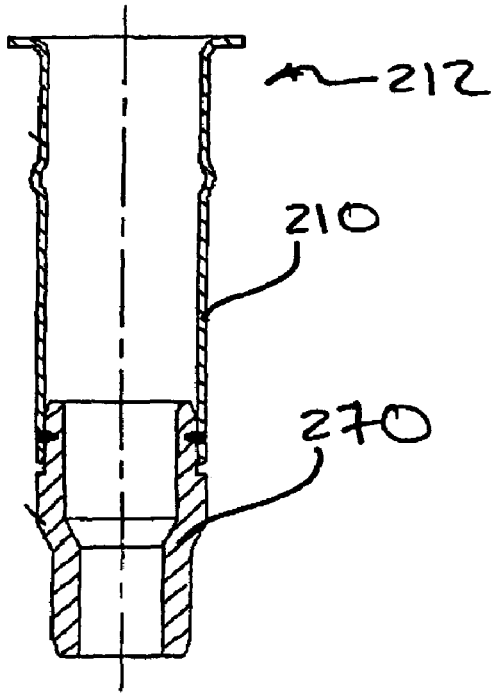

As shown in FIG. 2, inlet tube 210 can be attached to pole piece 270 by suitable attachment techniques such as, for example, welds. Preferably, the weld is formed by laser welding through the two members 210, 270. Formed into the outer surface of pole piece 270 are shoulder portions 276. Inlet tube end 214 can engage shoulder portions 276 for connection of the pole piece 270 with inlet tube 210. Moreover, a shoulder 277 can be formed on the interior surface of the power group subassembly 400 to act as a positive mounting stop when the fuel injector 100 is assembled. Specifically shown, for example, in FIG. 1 is the interaction of shoulder 277 with an interior portion of the power group subassembly 400, specifically a bobbin 405 forming an electromagnetic coil 402, as shown in FIG. 5A. As shown in FIGS. 2A and 2B, the length of pole piece 270 can be fixed whereas the length of inlet tube 210, 210' can be variable according to operating requirements. By forming inlet tube 210 separately from pole piece 270, different length injectors can be manufactured by using different inlet tube lengths during the assembly process. As shown in FIGS. 2A and 2B, inlet tube 210 can be flared at the inlet end 212 to retain a sealing or O-ring 290 circumscribed about the first tube end 110, as seen in FIG. 1. Alternatively to the configurations shown in FIGS. 1, 1A, 2, 2A and 2B, the inlet tube 210 can be attached to the separate pole piece 270 at an inner circumferential surface of the pole piece 270.

Shown in FIGS. 1, 1A and 2 is an armature assembly 300 disposed in the tube assembly distally of the pole piece 270. Seen in greater detail in FIGS. 3 and 3C-3E, the armature assembly 300 includes an armature core 301 having a first armature core end 302 including an armature or ferromagnetic portion 304 and a second armature core end 306 having a sealing portion 308. The armature assembly 300 is disposed in the tube assembly 210 such that the ferromagnetic portion 304, or "armature," confronts the pole piece 270 at the second portion of the pole piece 274. The sealing portion 308 can include a preferably ferromagnetic closure member 310, e.g., a spherical valve element, that is moveable for regulating the flow of fluid through the fuel injector 100. Preferably, the closure member 310 is 440 C stainless steel and the armature core 301 is 430 FR stainless steel.

Figure 3:
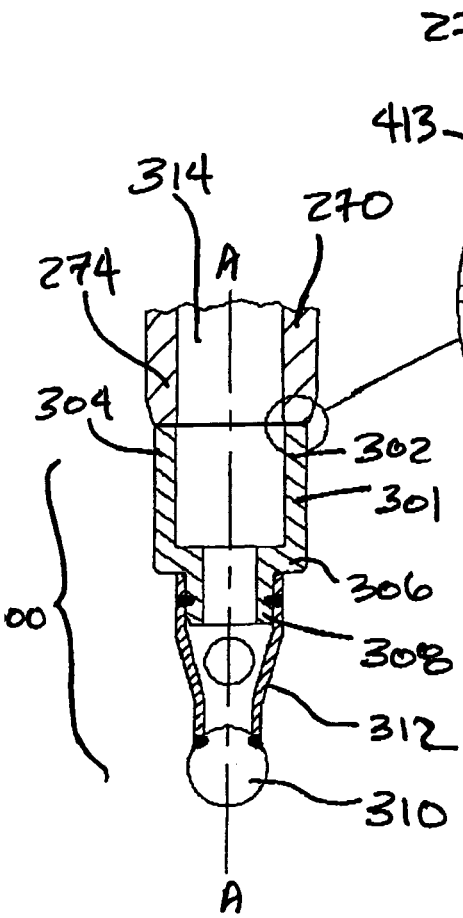
FIG. 3 is a cross-sectional view of a preferred embodiment of an armature assembly according to the present invention
Figure 3A:
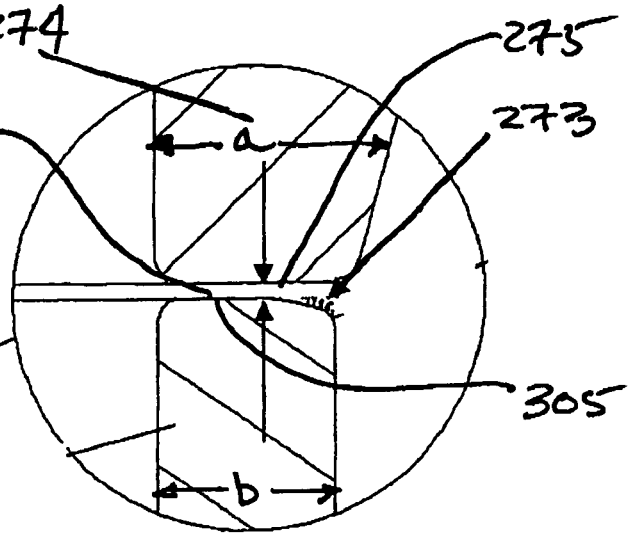
FIG. 3A is a close-up view of a portion of FIG. 3A illustrating a preferred embodiment of surface treatments.

Shown in FIGS. 3 and 3A, the second portion 274 of pole piece 270 and the ferromagnetic portion 304 of the armature core 301 can define impact surfaces 275 and 305 respectively. Surface treatments can be applied to at least one of the impact surfaces 275, 305 and second portion 274 and ferromagnetic portion 304 to improve the armature's response, reduce wear on the impact surfaces or variations in the working air gap between the respective portions 274 and 304. The surface treatments can include coating, plating or case-hardening. Coatings or platings can include, but are not limited to, hard chromium plating, nickel plating or keronite coating. Case hardening on the other hand, can include, but are not limited to, nitriding, carburizing, carbonitriding, cyaniding, heat, flame, spark or induction hardening. Preferably, the coating is a chromium plating.

Figure 3B:
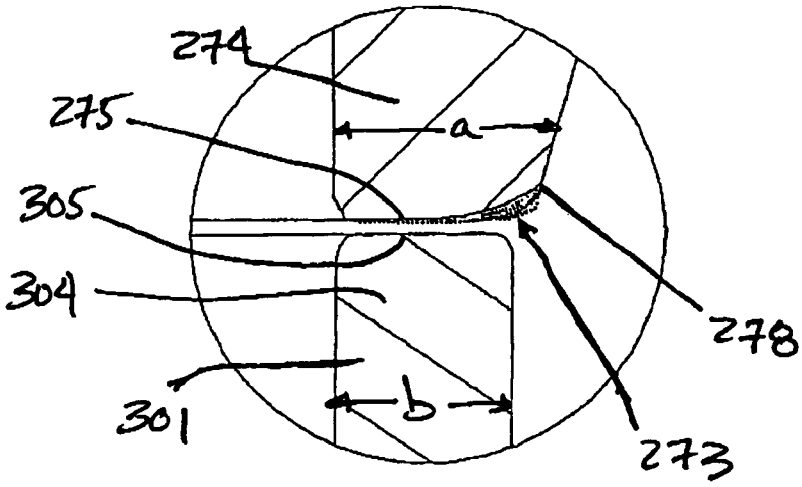
FIG. 3B is a close-up view of another preferred embodiment of surface treatments for the impact surfaces of the armature assembly in FIG. 3.

The surface treatments will typically form at least one layer of wear-resistant material 273 on the respective portions 274, 304 of the pole piece 270 and armature core 301. These layers, however, tend to be inherently thicker wherever there is a sharp edge or junction between the circumference and the radial end face of either portions 274, 304. Moreover, this thickening effect results in uneven contact surfaces at the radially outer edge of the end portions. However as seen in the detail of FIGS. 3A and 3B, by forming the wear-resistant layers on at least one of the portions 274 and 304, where the at least one portion 274 or 304 has a surface generally oblique to longitudinal axis A-A, both impact surfaces 275, 305 are now substantially in mating contact with respect to each other due to the thickening of the layers on the oblique surface. As shown in FIG. 3, the portions 274, 304 are generally centrally and coaxially disposed about the longitudinal axis A-A. The outer surface of at least one of the end portions 274, 304, for example, outer surface 278 of second portion 274 of pole piece 270, can be of a general conic, frustoconical, spheroidal or a surface generally oblique with respect to the axis A--A. Preferably, at least one of the oblique surfaces of portions 274, 304 defines an oblique angle of about $2^N$ with respect to an axis orthogonal to longitudinal axis A-A. Alternatively and preferably, at least one of the oblique surfaces of portions 274, 304 defines an arcuate surface relative to longitudinal axis A-A.

Since the surface treatments can affect the physical and magnetic properties of the ferromagnetic portion 304 of the armature core 301 or the pole piece 270, a suitable material, e.g., a mask, a coating or a protective cover, can surround areas other than the respective end portions 304 and 274 during the surface treatments. Upon completion of the surface treatments, the material can be removed, thereby leaving the previously masked areas unaffected by the surface treatments.

Figure 3C:
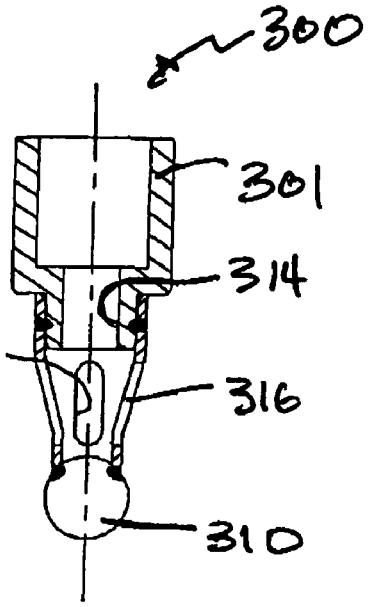
FIGS. 3C-3D are alternative preferred embodiments of a three-piece armature assembly.
Figure 3D:
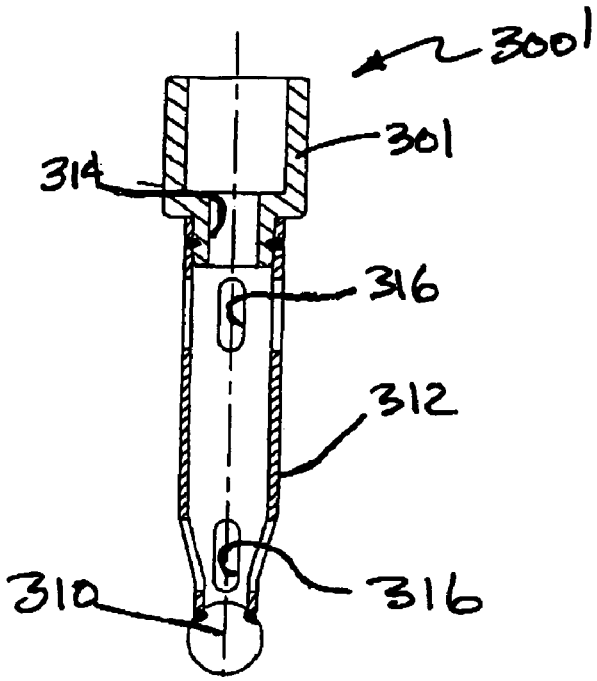
Figure 3E:
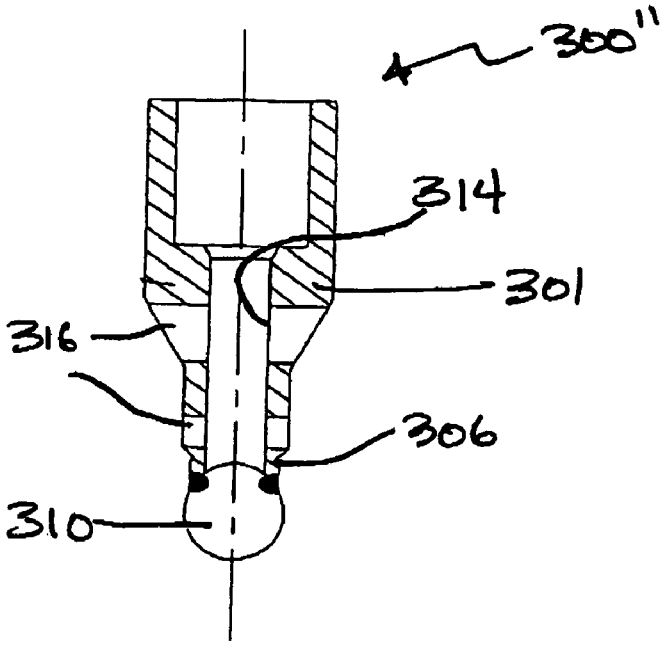
FIG. 3E is a cross-sectional view of preferred embodiment of a two-piece armature assembly.

FIGS. 3, 3C and 3D show a three-piece armature assembly 300 including the armature core 301, an intermediate portion or armature tube 312, and the closure member 310. The three-piece armature assembly 300 preferably includes the separately formed armature tube 312 for connecting the ferromagnetic portion 304 to the closure member 310. The armature tube 312 can be fabricated by various techniques, for example, a plate can be rolled and its seams welded or a blank can be deep-drawn to form a seamless tube. The armature tube 312 is preferable due to its ability to reduce magnetic flux leakage from the magnetic circuit of the fuel injector 100. This ability arises from the armature tube 312 being formed from non-magnetic material, thereby magnetically decoupling the magnetic portion or ferromagnetic portion 304 from the ferromagnetic closure member 310. Because the ferromagnetic closure member 310 is decoupled from the ferromagnetic portion 304, flux leakage is reduced, thereby improving the efficiency of the magnetic circuit. An additional variation of the three-piece armature assembly 300 is shown in FIG. 3D in the form of an extended tip three-piece armature assembly 300' in which the armature tube 312 can be substantially elongated. Alternatively, a two-piece armature assembly 300", shown here in FIG. 3E, includes the armature core 301 and the second armature core end 306 configured for direct connection to the closure member 310. Although the three-piece and the two-piece armature assemblies 300, 300', 300" are interchangeable, the three-piece armature assembly 300 or 300' is preferable due to magnetic decoupling feature of the armature tube 312.

Fuel flow through the armature assembly 300 can be provided by at least one axially extending through-bore 314 and at least one aperture 316 through a wall of the armature assembly 300. Any number of apertures can be provided as needed for a given application. The aperture 316, which can be of any shape, can preferably be noncircular, e.g., axially elongated, as shown in FIG. 3C to facilitate the passage of gas bubbles. For example, in the three-piece armature assembly 300 having an armature tube 312 that is formed by rolling a sheet substantially into a tube, the aperture 316 can be an axially extending slit defined between non-abutting edges of the rolled sheet. However, armature tube 312, in addition to the aperture 316, would preferably include additional openings extending through the sheet as is required for a given application. The aperture 316 provides fluid communication between the at least one through-bore 314 and the interior of the valve body 250. Thus, in the open configuration, fuel can be communicated from the through-bore 314, through the aperture 316 and the interior of the valve body 250, around the closure member 310, and through the opening into the engine (not shown). The elongated apertures 316 serve two related purposes. First, the elongated apertures 316 allow fuel to flow out of the armature tube 312. Second, the elongated apertures 316 allow hot fuel vapor in the armature tube 312 to vent into the valve body 250 instead of being trapped in the armature tube 312, and also allows pressurized liquid fuel to displace any remaining fuel vapor trapped therein during a hot start condition. In the case of the two-piece armature assembly 300", the aperture 316 can be formed directly in the armature core 301 proximate the second armature core end 306 as is shown in FIG. 3D.

Figure 4:
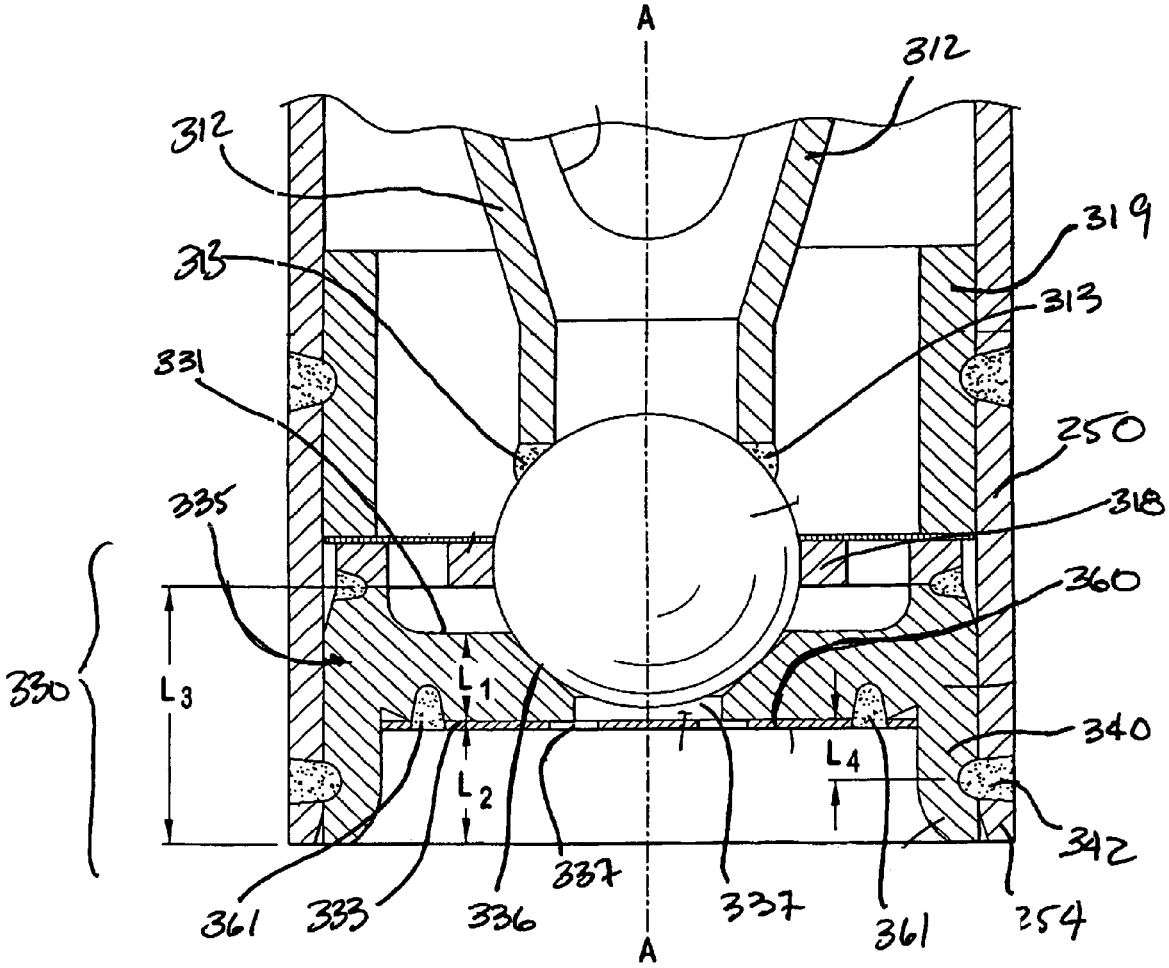
FIG. 4 is a cross-sectional view of a preferred embodiment of a seat assembly and closure member usable with the preferred embodiments of the present invention.

Shown in FIGS. 1, 1A and 2 is a seat assembly 330 engaged with the closure member 310. The seat assembly 330 is secured at the second end of the tube assembly 202, and more specifically, the seat assembly 330 is secured at the second valve body end 254. Shown in greater detail in FIG. 4 is seat assembly 330, which can include a flow portion 335 and a securement portion 340. The flow portion 335 extends generally along the longitudinal axis A-A over a first length $L_1$ between a first surface 331 and a second surface or disk retention surface 333. The securement portion 340 extends distally from the second surface 333 generally along the longitudinal axis over a second length $L_2$. Length $L_2$ can preferably be dimensioned such that the second length is at least equal to the first length $L_1$ and more preferably greater than $L_1$. Both portions extend generally along the longitudinal axis over a third length $L_3$ greater than either one of $L_1$ or $L_2$.

The flow portion 335 and more of the seat assembly 330 defines a first or sealing surface 336 and an orifice 337 preferably centered on the axis A-A and through which fuel can flow into the internal combustion engine (not shown). The sealing surface 336 surrounds the orifice 337 and can preferably be configured for contiguous engagement in one position of the closure member 310. The orifice 337 is preferably coterminous with the second or disk retention surface 333. The sealing surface 336, which faces the interior of the valve body 350, can be frustoconical or concave in shape, and can have a finished surface, e.g. polished or coated. An orifice disk 360 can be used in connection with the seat assembly to provide oriented orifice 337 to provide a particular fuel spray pattern and targeting. The precisely sized and oriented orifice 337 can be disposed on the center axis of the orifice disk 360 or, preferably disposed off-axis, and oriented in any desirable angular configuration relative to the longitudinal axis A-A or any one or more reference points on the fuel injector 100. It should be noted that both the seat assembly 330 and orifice disk 360 can be fixedly attached to the valve body 250 by known conventional attachment techniques, including, for example, laser welding, crimping, and friction welding or gas welding. The orifice disk 360 is preferably tack welded with welds 361 to the orifice disk retention surface 333 in a fixed spatial (radial and/or axial) orientation to provide the particular fuel spray pattern and targeting of the fuel spray.

The securement portion 340 of the seat assembly 330 preserves the spatial orientation between first surface 331, disk retention surface 333 and preferably includes orifice disk 360. Specifically, the securement portion 340 can be dimensioned and configured so as to prevent substantial deformation to the surfaces 331, 333 and orifice disk 360 upon applying heat from, for example, a weld. The seat assembly 330 can be attached to the valve body 250 by any suitable technique, such as, for example, laser welding or tack welding. Preferably, the securement portion 340 is secured to the inner surface of the valve body 250 with a continuous laser seam weld 342 extending from the outer surface of the valve body 250 through the inner surface of the valve body 250 and into a portion of the securement portion 340 in a pattern that can circumscribe the longitudinal axis A-A such that the seam weld 342 forms a hermetic lap seal between the inner surface of the valve body 250 and the outer surface of the securement portion 340. Also preferably, the seam weld 342 can be located at a distance $L_4$ distally at about 50% of the second length $L_2$ from the disk retention surface 333. By locating the seam weld 342 at such a position from the flow portion 335 so as to be sufficiently far from the sealing surface 336, the orifice 337 and orifice disk 360 are fixed in a desired orientation. Preferably, the fixed configuration of the orifice disk 360 relative to the seat assembly 330 prior to its installation in the valve body 250 is maintained within a tolerance of ±0.5% with respect to a predetermined configuration. In addition, the dimensional symmetry (i.e., circularity roundness, perpendicularity or a quantifiable measurement of distortion) of the flow portion 335 or the orifice disk 360 about the longitudinal axis A-A is approximately less than 1% as compared to such measurements prior to the seat assembly 330 being secured in the valve body. An O-ring 338 can be located between seat assembly and the interior of valve body 250 for ensuring a tight seal between the seat assembly and the interior of the valve body 250. Preferably, the seat 350 is 416 H stainless steel, guide 318 is 316 stainless steel and valve body 250 is 430 Li stainless steel.

Figure 4A:
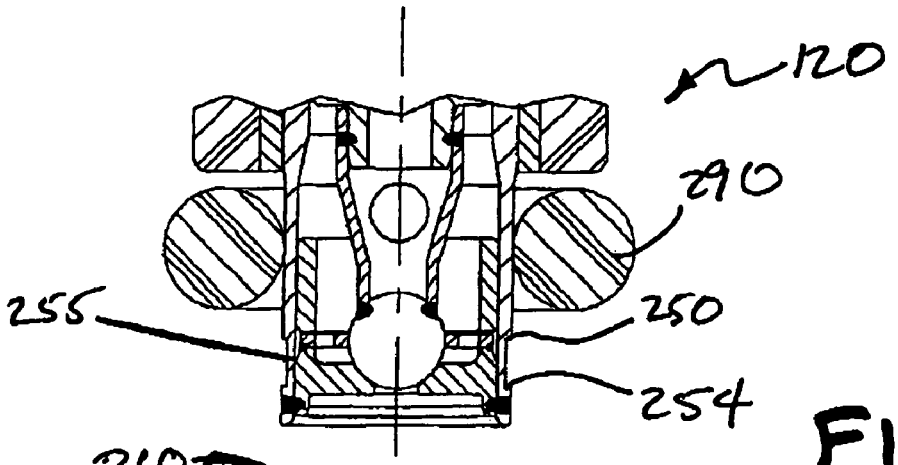
FIGS. 4A-4C are cross-sectional views of a preferred embodiment of a valve body and a retainer.
Figure 4B:
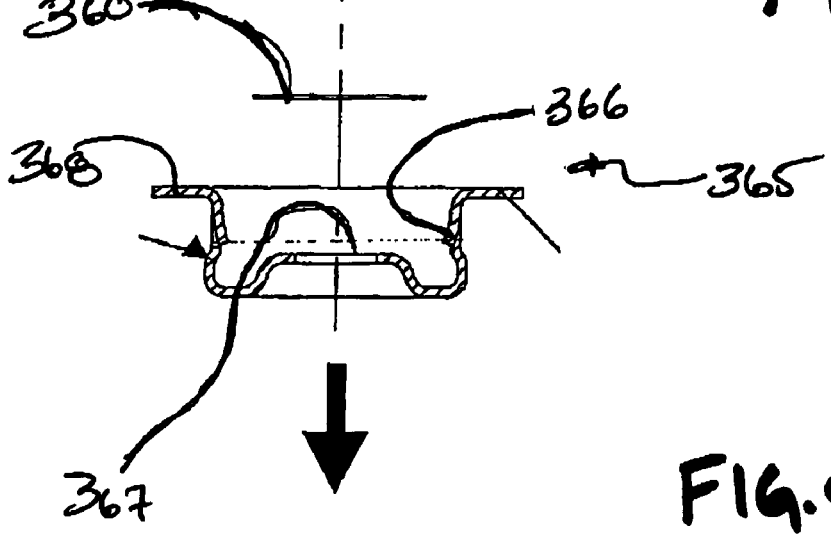
Figure 4C:
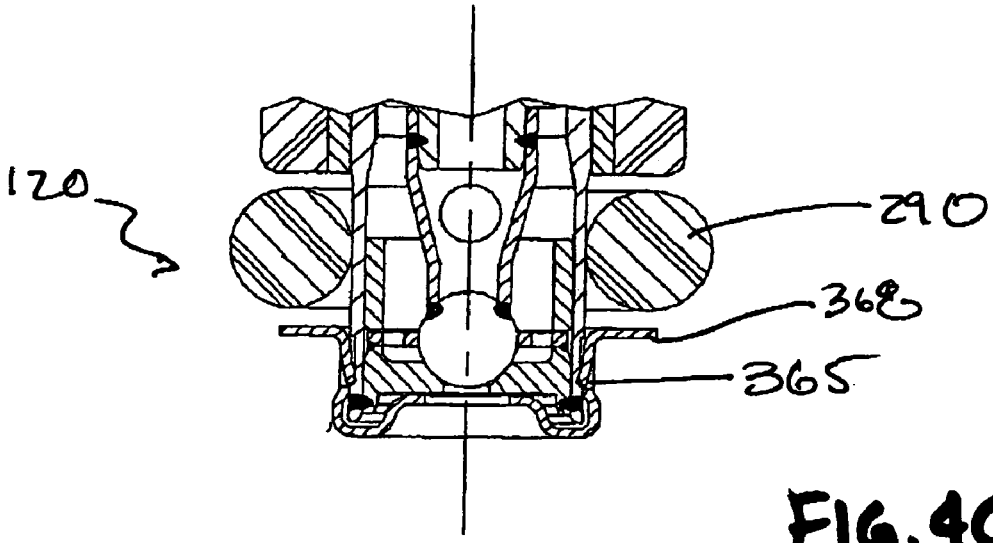
Figure 4D:
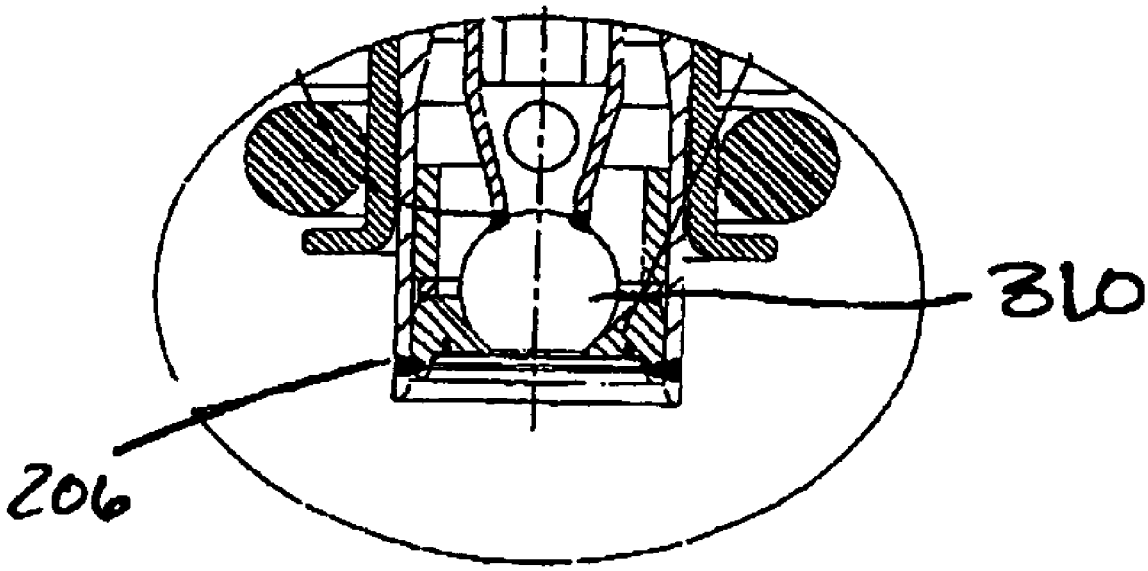
FIG. 4D is a cross-sectional view of a preferred embodiment of a closure member and seat assembly.

In addition to welding the orifice disk 360, a retainer 365, as seen in FIGS. 4A-4C, can be located at the second valve body end 254 for retaining a sealing or O-ring 290. Shown in FIGS. 4A-4C is a partial cross-sectional view of a preferred embodiment of the second injector end 120 with an O-ring 290 supported or retained by retainer 365 so as to properly seal the second injector end 120. The retainer 365 includes finger-like locking portions 366 allowing the retainer 365 to be snap-fitted on a complementarily grooved portion 255 of the valve body 250. Additionally, retainer 365 can include a dimple or recess 367 for engaging a portion of the seat assembly 330. Preferably, retainer 365 is configured to engage the orifice disk 360 and securement portion 340. To ensure that the retainer 365 is imbued with sufficient resiliency, the thickness of the retainer 365 should be at most one-half the thickness of the valve body 250. In order to support the O-ring 290, the retainer 365 can preferably include a flange 368.

Other seat assemblies can be utilized to control spray trajectory, such as, for example, the seat assembly shown and described in the following copending applications which are incorporated herein by reference thereto: U.S. patent application Ser. No. 09/568,464, entitled, "Injection Valve With Single Disc Turbulence Generation;" U.S. Patent Publication No. 2003-0057300-A1, U.S. patent application Ser. No. 10/247,351, entitled, "Injection Valve With Single Disc Turbulence Generation;" U.S. Patent Publication No. 2003-0015595-A1, U.S. patent application Ser. No. 10/162,759, entitled, "Spray Pattern Control With Non-Angled Orifices in Fuel Injection Metering Disc;" U.S. Patent Publication No. 2004-0000603-A1, U.S. patent application Ser. No. 10/183,406, entitled, "Spray Pattern and Spray Distribution Control With Non-Angled Orifices In Fuel Injection Metering Disc and Methods;" U.S. Patent Publication No. 2004-0000602-A1, U.S. patent application Ser. No. 10/183,392, entitled, "Spray Control With Non-Angled Orifices In Fuel Injection Metering Disc and Methods;" U.S. Patent Publication No. 2004-0056113, U.S. patent application Ser. No. 10/253,467, entitled, "Spray Targeting To An Arcuate Sector With Non-Angled Orifices In Fuel Injection Metering Disc and Methods;" U.S. Patent Publication No. 2004-0056115-A1, U.S. patent application Ser. No. 10/253,499, entitled, "Generally Circular Spray Pattern Control With Non-Angled Orifices In Fuel Injection Metering Disc and Methods;" U.S. patent application Ser. No. 10/753,378, entitled, "Spray Pattern Control With Non-Angled Orifices Formed On A Dimpled Fuel Injection Metering Disc Having A SAC Volume Reducer;" U.S. patent application Ser. No. 10/753,481, entitled, "Spray Pattern Control With Non-Angled Orifices Formed On A Generally Planar Metering Disc and Subsequently Dimpled With A SAC Volume Reducer;" U.S. patent application Ser. No. 10/753,377, entitled, "Spray Pattern Control With Non-Angled Orifices Formed A Generally Planar Metering Disc and Reoriented On Subsequently Dimpled Fuel Injection Metering Disc."

Referring to FIGS. 1 and 4, the closure member 310 can be movable between a first position, so as to be in a closed configuration, and a second position so as to be in an open configuration (not shown). In the closed configuration, the closure member 310 contiguously engages the sealing surface 336 to prevent fluid flow through the orifice 337. In the open configuration, the closure member 310 is spaced from the sealing surface 336 so as to permit fluid flow through the orifice 337 via a gap between the closure member 310 and the sealing surface 336. In order to ensure a positive seal at the closure member 310 and sealing surface 336 interface when in the closed configuration, closure member 310 can be attached to armature tube 312 by welds 313 and biased by a resilient member 370 so as to sealingly engage the sealing surface 336. Welds 313 can be internally formed between the junction of the armature tube 312 and the closure member 310. To achieve different spray patterns or to ensure a large volume of fuel injected relative to a low injector lift height, it is preferred that the spherical closure member 310 can be in the form of a flat-faced ball, shown enlarged in detail in FIGS. 4B.

In the case of where the closure member is in the form of a spherical valve element, for example closure member 310, the spherical valve element can be connected to the second armature portion 306 or armature tube 312 at a diameter that is less than the diameter of the spherical valve element. Such a connection would be on side of the spherical valve element that is opposite contiguous contact with the sealing surface 336. Again referencing FIG. 4, lower armature guide 318 can be preferably disposed in the tube assembly, proximate the seat assembly 330, so as to slidingly engage the diameter of the closure member 310. The lower armature guide 318 can additionally facilitate alignment of the armature assembly 300 along the axis A-A.

Referring back to FIGS. 1, 1A and 2, the resilient member 370, preferably in the form of a helical spring, can be disposed in the tube assembly so as to bias the armature assembly 300 toward the seat assembly 330. The resilient member 370 can be further preferably dimensioned and configured so as to engage the interior face 307 of the first armature assembly end 302. The resilient member 370 can also be engaged by an adjusting tube 375. The adjusting tube 375 can preferably be disposed generally proximate the resilient member 375. The adjusting tube 375 engages the resilient member 370 and adjusts the biasing force of the member 370 with respect to the tube assembly. In particular, the adjusting tube 375 provides a reaction member against which the resilient member 370 reacts in order to bring the armature assembly 300 and closure member 310 to the closed position upon de-energization of the solenoid or the electromagnetic coil 402. The position of the adjusting tube 375 can be retained with respect to the inlet tube 210 by an interference fit between the adjusting tube 375 and a portion of the interior of the inlet tube 210 or separate pole piece 270. The adjusting tube 375 can be configured in any manner so as to facilitate a preferred engagement with the filter assembly 380 and resilient member 370, insertion into the inlet tube 210 and interference with at least a portion of the interior of the inlet tube 210 or separate pole piece 270. Thus, the position of the adjusting tube 375 with respect to the inlet tube 210 can be used to set a predetermined dynamic characteristic of the armature assembly 300.

Further affecting the ability of the closure member 310 to seal and the overall performance of the fuel injector 100 is the setting of the lift of the armature assembly. Lift is the amount of axial displacement of the armature assembly 300 defined by the working air gap 413 between the pole piece 270 and the armature core 301, shown in FIG. 3A, and as determined by the relative axial spatial relation between either the non-magnetic shell 230 and valve body 250; non magnetic shell 230 and inlet tube 210; or seat assembly 330 and valve body 250. To set the lift, i.e., ensure the proper injector lift distance, there are at least four different techniques that can be utilized. According to a first technique, a crush ring or a washer can be inserted into the valve body 250 between the lower guide 318 and the valve body 250. The crushing ring is axially deformable by a known amount. Upon engaging the armature assembly 300 with the seat assembly 330, the intermediate crush ring is deformed by a known amount that corresponds to the desired amount of lift between the armature assembly 300 and seat assembly 330. According to a second technique, the relative axial position of the valve body 250 and the non-magnetic shell 230 can be adjusted and measured before the two parts are affixed together. According to a third technique, the relative axial position of the nonmagnetic shell 230 and the pole piece 270 can be adjusted before the two parts are affixed together. And according to a fourth technique, a lift sleeve 319 can be displaced axially within the valve body 250. If the lift sleeve technique is used, the position of the lift sleeve 319 can be adjusted by moving the lift sleeve 319 axially. The lift distance can be measured with a test probe. Once the lift is correct, the sleeve 319 can be fixed or other wise welded to the valve body 250, e.g., by laser welding. The assembled valve group subassembly 200 can then be tested, e.g., for leakage.

Referring again to FIGS. 1, 1A and 2 fuel injector 100 can additionally include a filter assembly 380 having a filter element 382. The filter element 382 includes an intake surface 384 and discharge surface 386 defining a fluid flow path. The filter element 382 can be of any shape that can be accommodated within inlet tube 210, for example, cylindrical shaped or more preferably frustoconical or conical. As seen in FIGS. 1, 1A and 2, the filter assembly 380 is preferably engaged with the adjusting tube 375. Alternatively, the filter assembly 380 can be disposed proximate the first inlet tube end 212. To facilitate positioning of the filter assembly 380 proximate the first tube inlet end 212, the filter assembly can further include an integral-retaining portion 387 for supporting the filter assembly 380 at the first inlet tube end 212. The integral-retaining portion 387 can be dimensioned and configured so as to further support an O-ring 290 circumscribed about the first tube assembly end 204 so as to provide a seal at a connection of the injector 100 to a fuel source (not shown). Preferably, the filter assembly 380 can be substantially enclosed within the inlet tube 210. In FIG. 1, the filter assembly 380 and filter element 382 can be configured such that such that at least a portion of the fluid flow path is substantially normal to the longitudinal axis, for example, wherein the intake surface 384 of the filter element 382 is substantially parallel to the longitudinal axis such that the fluid flows therethrough is substantially normal to the longitudinal axis. Alternatively the intake surface 384 and discharge surface 386 can define a fluid flow path that is substantially parallel or coaxial with the axis A-A.

The valve group subassembly 200 can be assembled as follows. The non-magnetic shell 230 is connected to the inlet tube 210 and to the valve body 250 so as to form the tube assembly 202. The armature assembly 300, preferably including the armature tube 312 and closure member 310 is inserted into the tube assembly 202 at the second tube assembly end 206. In addition, the resilient member 370 can be inserted with the armature assembly 300 at the second tube assembly end 206. Wherein any of the previously described lift setting techniques are utilized, the seat assembly 330 can be inserted into the tube assembly at the second tube assembly end 206. Preferably where either a crush ring or lift sleeve has been used, the seat assembly 300 with preferred orifice disk 360 and armature guide 224 affixed, is preassembled prior to insertion into the tube assembly 202. With the lift properly set, the seat assembly can be accordingly affixed to the valve body in a manner as previously described. The resilient member 370 and adjusting tube 375 can be loaded into the tube assembly 202 at the first tube assembly end 204. The adjusting tube 375 can be located within the tube assembly so as to preload the resilient member 375 thereby adjusting the dynamic properties of the resilient member 375, e.g., so as to ensure that the armature assembly 300 does not float or bounce during injection pulses. Preferably the adjusting tube 375 is fixed with respect to the inlet tube 210 by an interference fit in a manner as previously described. Preferably, the filter assembly 380 can be preassembled and engaged with the adjusting tube 375 so as to be disposed within tube assembly 202 upon insertion of the adjusting tube 375 into the tube assembly 202. Alternatively, the filter assembly 380 having an integral-retaining portion 386 for insertion can be fixedly positioned at the first inlet tube end 212 of the inlet tube 210. The retainer 365 can be affixed at the second valve body end 254 of valve body 250.

Figure 5:
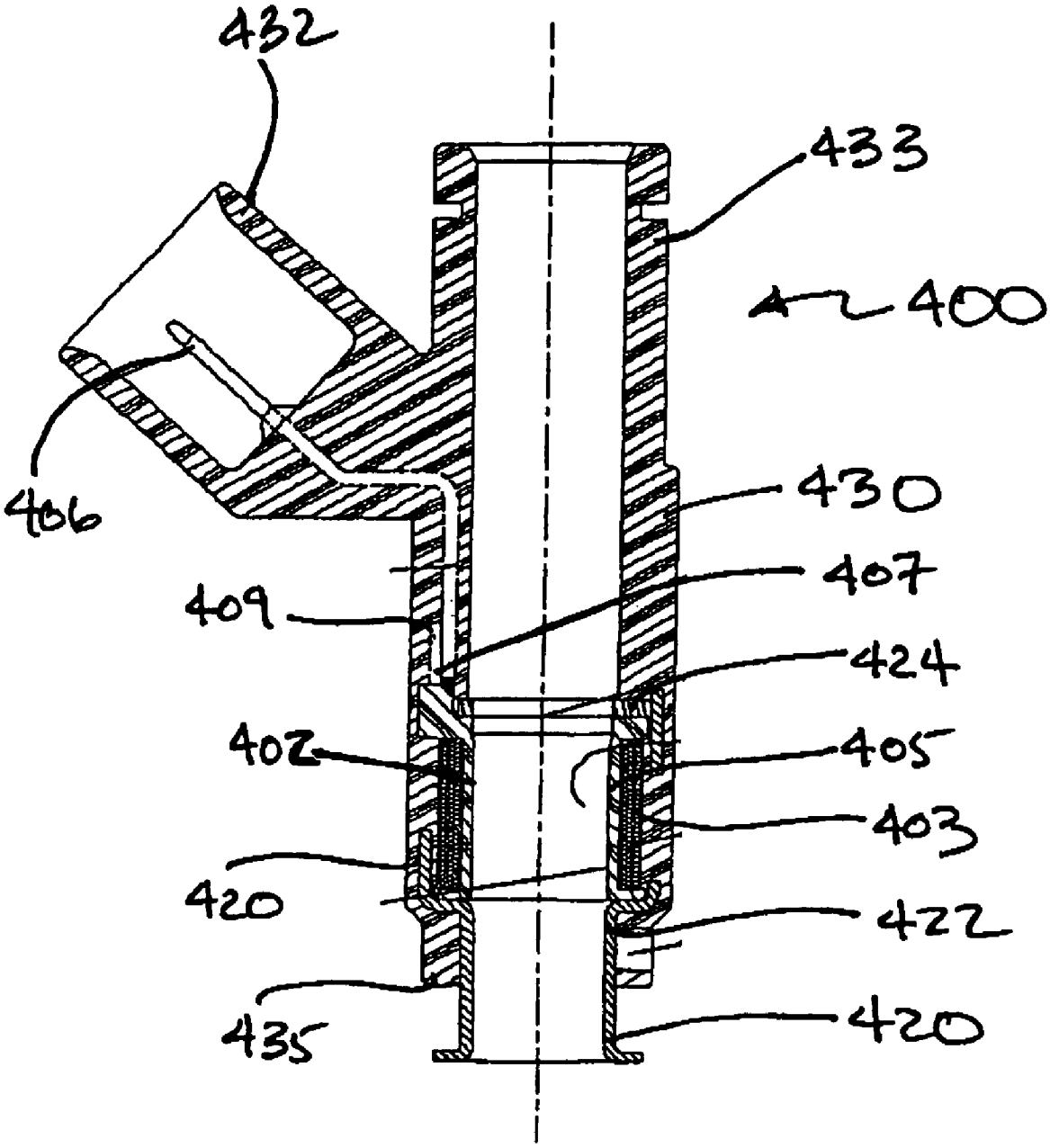
FIG. 5 is a cross-sectional view of a preferred embodiment of a power group subassembly.
Figure 5A:
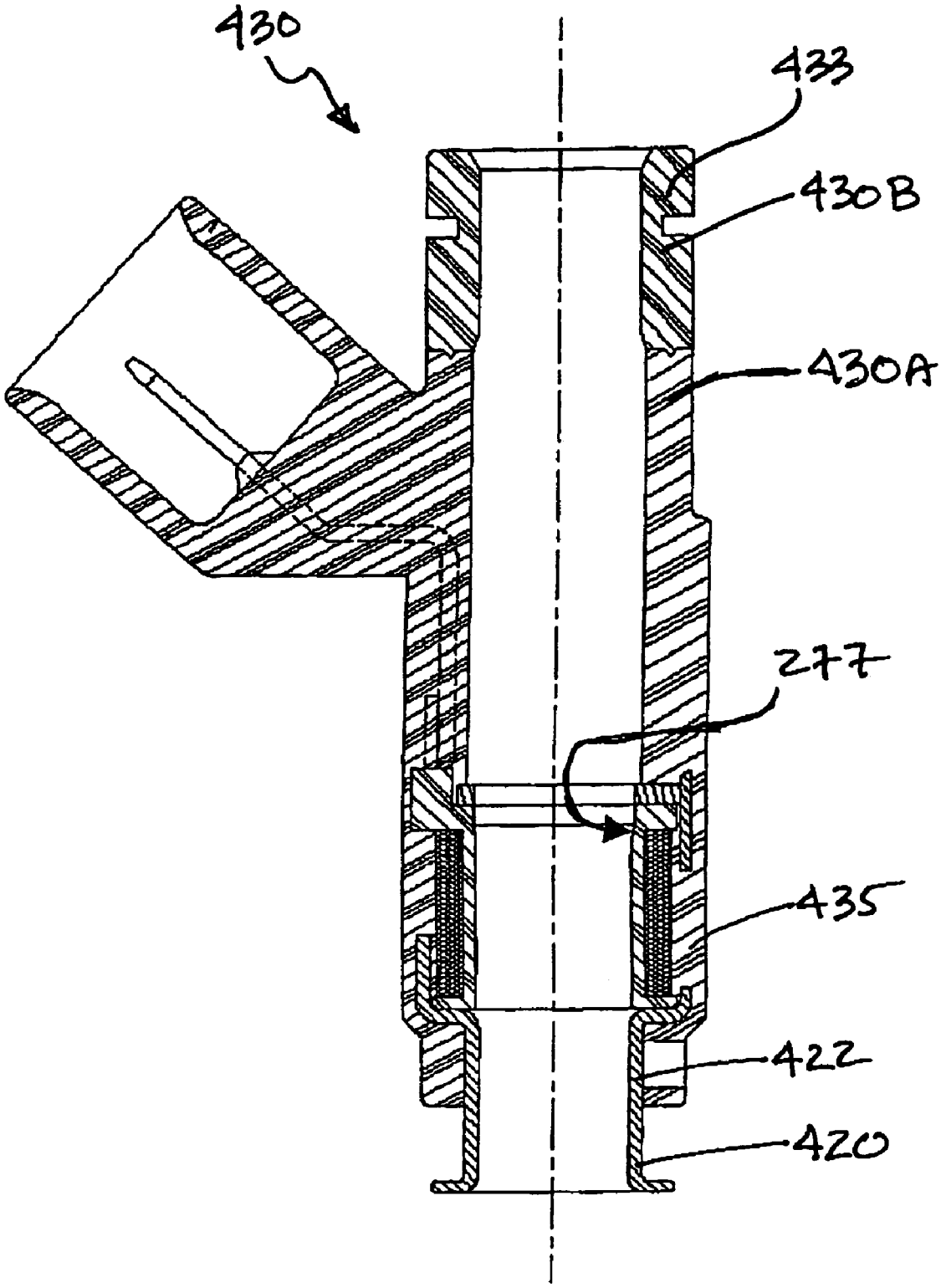
FIG. 5A is an exploded view of another preferred embodiment of a power group subassembly.

Referring to FIG. 5, the power group subassembly 400 includes a solenoid or electromagnetic coil 402 for generating a magnetic flux, at least one terminal 406, a housing 420, and at least one overmold 430. The electromagnetic coil 402 can include a wire 403 that that can be wound on a bobbin 405 and electrically connected to a planar surface at least one electrical contact 407 on the bobbin 405. The terminal 406 can have a generally planar surface contiguous with a generally planar surface of a terminal connector 409 to allow for electrical communication. The housing 420 generally includes a ferromagnetic cylinder 422 surrounding at least a portion of the electromagnetic coil 402 and a flux washer 424 extending from the cylinder 422 toward the axis A-A. The washer 424 can be integrally formed with or separately attached to the cylinder 422. The housing 420 can include holes, slots, or other structures to break-up eddy currents that can occur when the coil is energized. The overmold 430 maintains the relative orientation and position of the electromagnetic coil 402, the at least one terminal 406 (two are used in the illustrated example), and the housing 420. The overmold 430 can include an electrical harness connector portion 432 in which a portion of the terminal 406 is exposed. The terminal 406 and the electrical harness connector portion 432 can engage a mating connector, e.g., part of a vehicle wiring harness (not shown), to facilitate connecting the fuel injector 100 to an electrical power supply (not shown) for energizing the electromagnetic coil 402. The overmold 430 when formed includes a proximal or first overmold end 433 proximate the harness connector and a distal or opposite second overmold end 435. An exploded view of the power group subassembly is shown in FIG. 5A. Preferably, the overmold 430 and bobbin 405 are nylon 616, flux washer is 1008 steel, the coil housing 420 is 430 Li stainless steel.

Figure 6A:
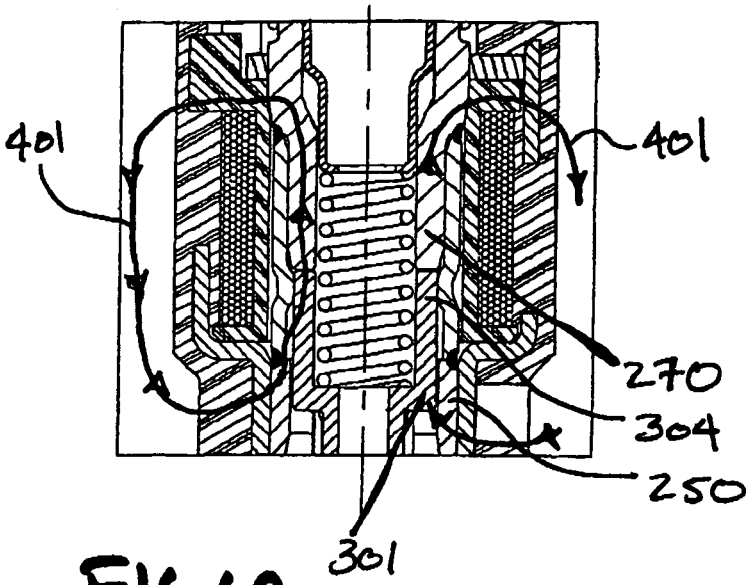
FIG. 6A-6B is a close-up cross-sectional view of preferred pole piece and armature assembly.
Figure 6B:
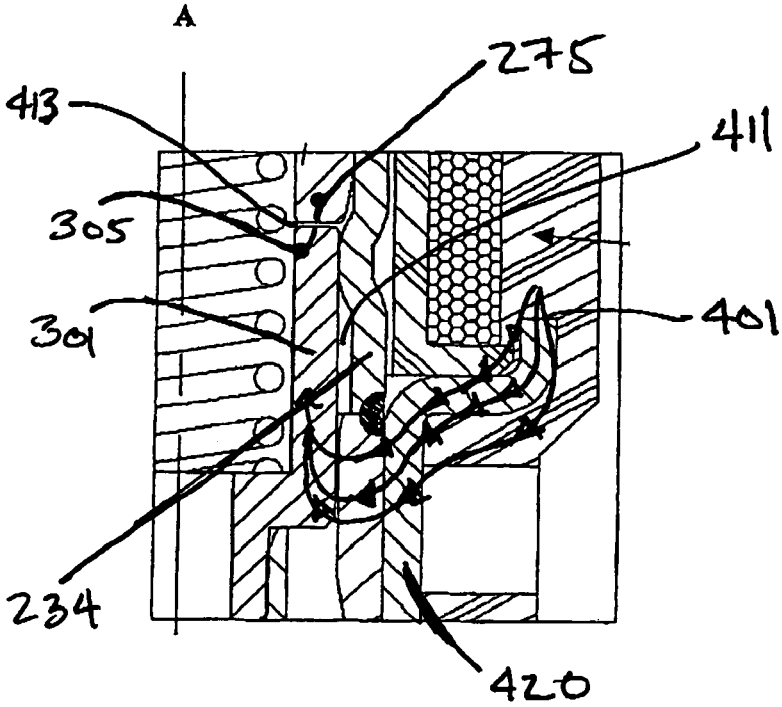

According to a preferred embodiment shown here in FIG. 6A, the magnetic flux 401 generated by the electromagnetic coil 402 flows in a circuit that includes, the pole piece 270, the armature assembly 300, the valve body 250, the housing 420, and the flux washer 424. As seen in FIGS. 6A and 6B, the magnetic flux 401 moves across a parasitic airgap 411 between the homogeneous material of the ferromagnetic portion 304 and the valve body 250 into the armature core 301 and across the working air gap 413 towards the pole piece 270, thereby lifting the closure member 310 off the seat assembly 330. Referring back to FIGS. 3A and 3B, the width "a" of the impact surface 275 of pole piece 270 is preferably greater than the width "b" of the cross-section of the impact surface 305 of ferromagnetic portion 304. The smaller cross-sectional area "b" allows the armature core 301 of the armature assembly 300 to be lighter, and at the same time, causes the magnetic flux saturation point to be formed near the working air gap 413 between the pole piece 270 and the ferromagnetic portion 304, rather than within the pole piece 270. The ratio of "b" to "a" should be something less than 1, and is preferably about 0.85. Furthermore, since the armature core 301 is partly within the interior of the electromagnetic coil 402, the magnetic flux 401 is denser, leading to a more efficient electromagnetic coil. Finally, as previously noted, because the ferromagnetic closure member 310 is magnetically decoupled from the ferromagnetic portion 304 via the armature tube 312, flux leakage of the magnetic circuit to the closure member 310 and the seat assembly 330 is reduced, thereby improving the efficiency of the electromagnetic coil 402.

The power group subassembly 400 can be constructed as follows. A plastic bobbin 405 can be molded with at least one electrical contact 407. The wire 403 for the electromagnetic coil 402 is wound around the plastic bobbin 405 and connected to the electrical contacts 407. The housing 420 is then placed over the electromagnetic coil 402 and bobbin 405. The terminal 406, which is pre-bent to a proper shape, is then electrically connected to each electrical contact 407 by known methods for example, brazing, soldered welding or, preferably, resistance welding between respective tips so that the tips abut each other on their circumference. Preferably, the generally planar surface of the terminal 406 is contiguous to the generally planar surface of the terminal connector 406. The partially assembled power group subassembly can be placed into a mold (not shown) for forming the overmold 430. The overmold 430 maintains the relative assembly of the coil/bobbin unit 402, 405, housing 420, and terminal 406. The overmold 430 also provides a structural case for the fuel injector 100 and provides predetermined electrical and thermal insulating properties. A separate collar 440 can be connected, e.g., by bonding, and can provide an application specific characteristic such as an orientation feature or an identification feature for the injector 100. Thus, the overmold 430 provides a universal arrangement that can be modified with the addition of a suitable collar 440. By virtue of its pre-bent shape, the terminal 406 can be positioned in the proper orientation for the harness connector 432 when a polymer is poured or injected into the mold. The assembled power group subassembly 400 can be mounted on a test stand to determine the solenoid's pull force, coil resistance and the drop in voltage as the solenoid is saturated. To reduce manufacturing and inventory costs, the coil/bobbin unit 402, 405 can be the same for different applications. As such, the terminal 406 and overmold 430 and/or collar 440 can be varied in size and shape to suit particular tube assembly lengths, mounting configurations, electrical connectors, etc. The preparation of the power group subassembly 400 can be performed separately from the fuel group subassembly 200.

Figure 5B:
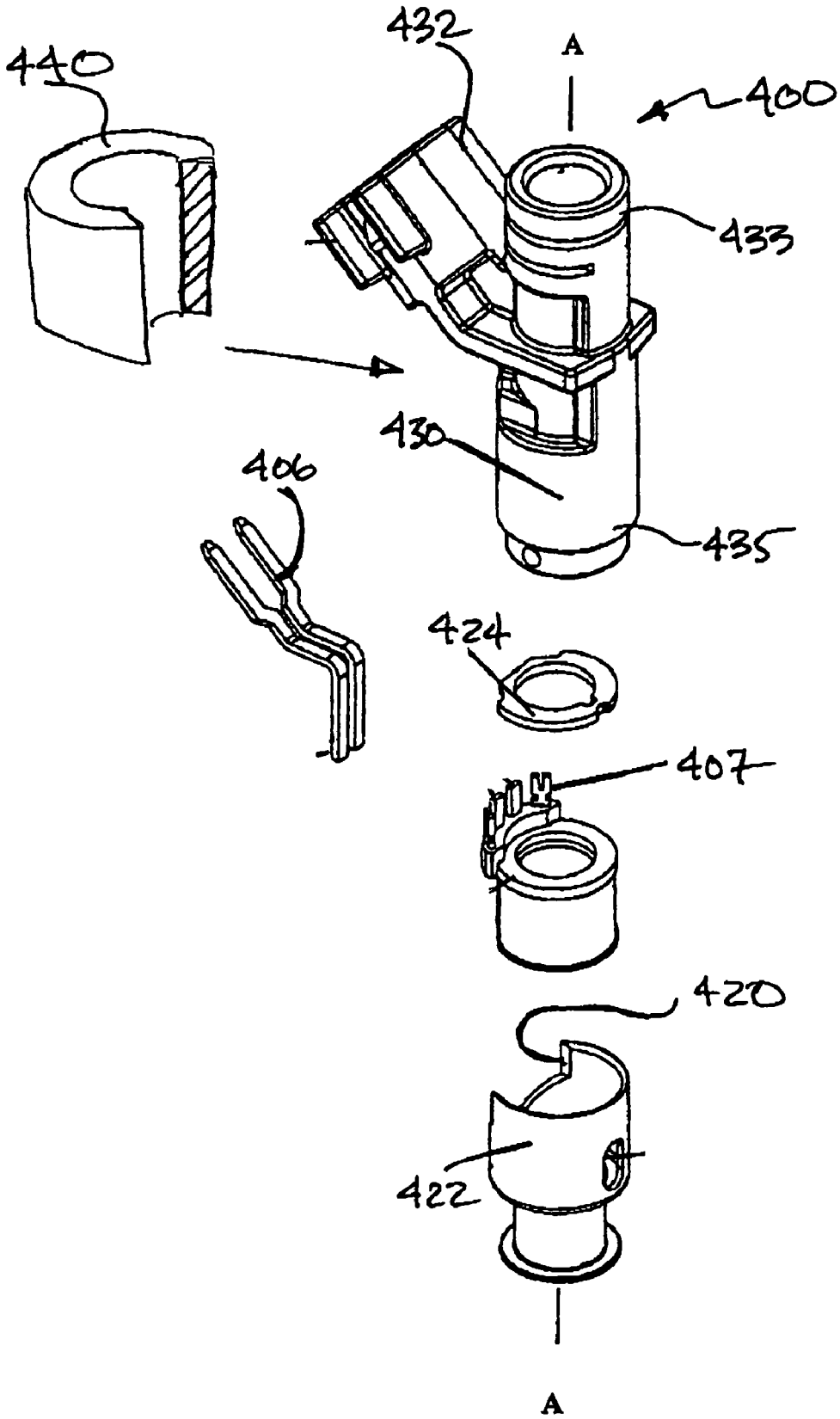
FIGS. 5B is an exploded view of the power group subassembly of FIG. 5.

Alternatively to the single overmold 430, a two-piece overmold 430' as shown in FIG. 5B, can be formed allowing for a first overmold 430A that is application specific while a second overmold 430B can be for all applications. Two separate molds (not shown) can be used to form the two-piece overmold 430'. The first overmold 430A can be bonded to the second overmold 430B, allowing both to act as electrical and thermal insulators for the injector. Additionally, as shown in FIG. 5A and in the cross-sectional views of FIGS. 1, a portion of the housing 420 can extend axially beyond an end of the overmold 430, 430' to allow the injector to accommodate different length injector tips. The overmold 430, 430' can be formed such that a portion of housing 420 can extend beyond the second overmold end 435. In addition, housing 420 can also be formed with a flange 421 to retain the O-ring 290. Flange 421 offers an alternate configuration to the flared portion 368 of retainer 365 for supporting the O-ring 290 as was previously described.

Figure 7:
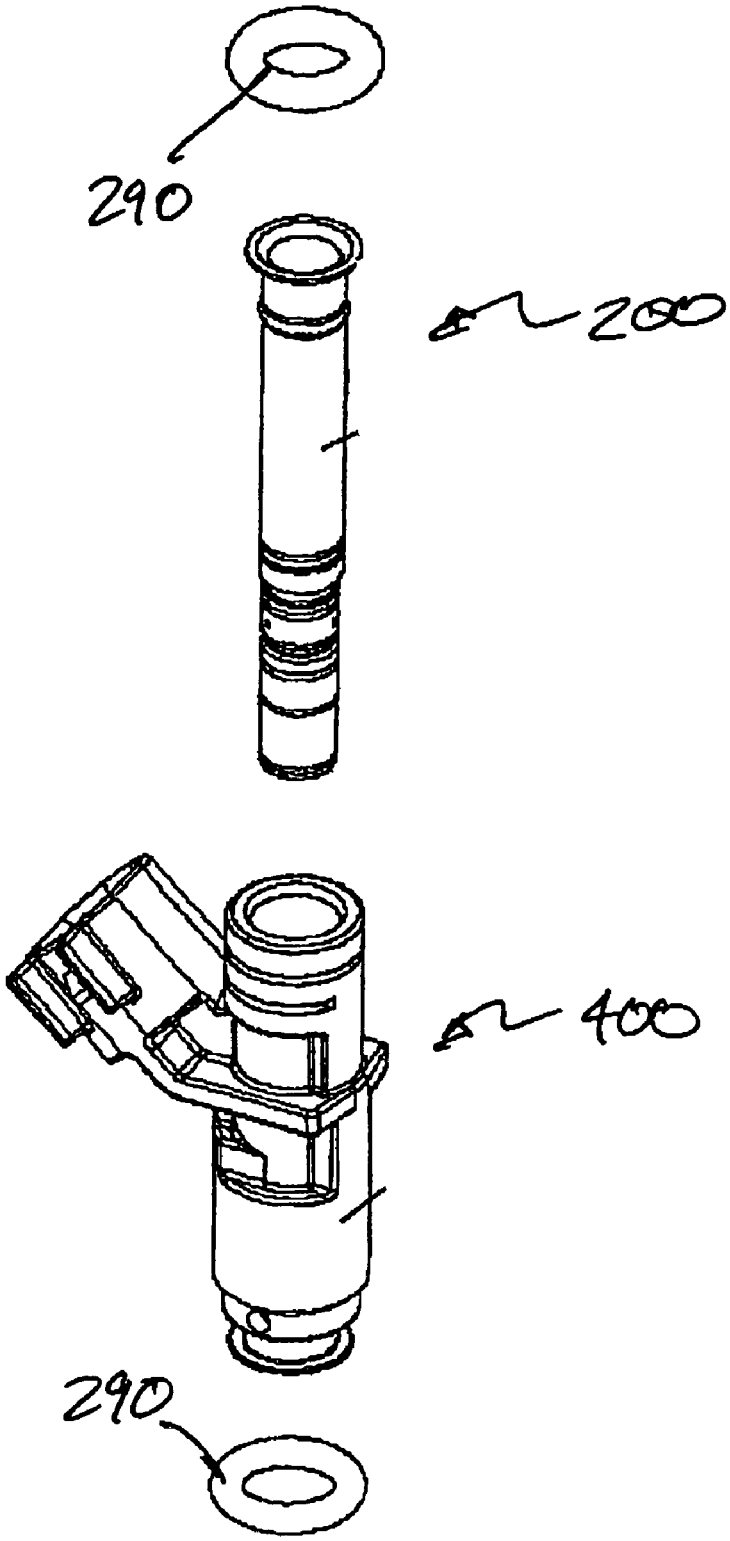
FIG. 7 is an exploded view illustrating the preferred modular configuration of the fuel injector of FIG. 1A.

The individual assembly and testing of the valve group subassembly 200 and the power group subassembly 400 is independent of one another and therefore the assembly and testing of each can be performed without concern as to sequence of assembly and test operation of the other. Referencing FIG. 7, to assemble the fuel injector 100, the valve group subassembly 200 can be inserted into the power group subassembly 400. Thus, the injector 100 can be made of two modular subassemblies 200, 400 that can be assembled and tested separately, and then connected together to form the injector 100. The valve group subassembly 200 and the power group subassembly 400 can be fixedly connected by adhesive, welding, or any other equivalent attachment process. Preferably, the overmold 430 includes a hole 434 that runs through the overmold 430 into and through the internally disposed housing 420 so as to expose a portion of the valve body 250. A laser weld can be formed in the hole 434 thereby joining the housing 420 to the valve body 250 and thus connecting the valve group subassembly 200 to the power group subassembly 400. In order to further facilitating the connection between the valve group subassembly 200 and the power group subassembly 400, the inlet tube 210 preferably includes the projection 213, as previously described, for an interference fit with the overmold 430. More preferably, the valve body 250 is dimensioned and configured so as to have a generally constant outer diameter such that upon assembly with the inlet tube 210 and non-magnetic shell 230 the tube assembly 200 defines a generally constant outer diameter substantially along the axial length of the tube assembly 200. In addition, the power group subassembly 400, more specifically, the overmold 430 defines a generally constant inner diameter to hold the tube assembly 200. The inserting of the valve group subassembly 200 into the power group subassembly 400 can involve setting the relative rotational orientation of the valve group subassembly 200 with respect to the power group subassembly 400. According to the preferred embodiments, the fuel group and the power group subassemblies 200, 400 can be rotated such that the included angle between reference point(s), for example, a first reference point on the orifice disk 360 (including opening(s) thereon) and a second reference point on the injector harness connector 434 can be set within a predetermined angle. The relative orientation can be set using robotic cameras or computerized imaging devices to look at respective predetermined reference points on the subassemblies, calculate the angular rotation necessary for alignment, orientating the subassemblies and then checking with another look and so on until the subassemblies are properly orientated. Once the desired orientation is achieved, the subassemblies 200, 400 can be inserted together. The insertion operation can be accomplished by one of at least two methods: "top-down" or "bottom-up." According to the former, the power group subassembly 400 is slid downward from the top of the valve group subassembly 200, and according to the latter, the power group subassembly 400 is slid upward from the bottom of the valve group subassembly 200. In situations where the inlet tube 210 includes a flared first end, the bottom-up method is required. Also in these situations, the O-ring 290 that is retained by the preferred flared first inlet tube end 212 can be positioned around the power group subassembly 400 prior to sliding the valve group subassembly 200 into the power group subassembly 400. After inserting the valve group subassembly 400 into the power group subassembly 200, these two subassemblies are affixed together in a manner as previously described. Finally, the O-ring 290 at either end of the fuel injector can be finally installed.

The use of O-rings 290 at the proximate and distal of the first and second overmold ends 433, 435 respectively ensure a tight seal connection between the fuel injector 300 and other engine components. For example, the first injector end 110 can be coupled to a fuel supply line of an internal combustion engine (not shown). The O-ring 290 can be used to seal the first injector end 110 to the fuel supply so that fuel from a fuel rail (not shown) is supplied to the tube assembly 202 with the O-ring 290 making a fluid tight seal, at the connection between the injector 100 and the fuel rail (not shown).

In operation of the fuel injector 100, the electromagnetic coil 402 can be energized, thereby generating magnetic flux 401 in the magnetic circuit. The magnetic flux 401 moves armature assembly 300 preferably along the axis A-A towards the pole piece 270 thereby closing the working air gap. This movement of the armature assembly 300 separates the closure member 310 from the seat assembly 330, places the closure member 310 in the open configuration and allows fuel to flow from the fuel rail (not shown), through the inlet tube 210, the through-bore 314, the apertures 316 and the valve body 250, between the seat assembly 330 and the closure member 310, through the orifice 337, and finally through the orifice disk 360 into the internal combustion engine (not shown). When the electromagnetic coil 402 is de-energized, the armature assembly 300 is moved by the bias of the resilient member 370 to contiguously engage the closure member 310 with the seat assembly 330, placing the closure member in the closed configuration, and thereby prevent fuel flow through the injector 100.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What I claim is:

1. A fuel injector for use with an internal combustion engine, the fuel injector comprising:

an independently testable power group subassembly connected with an independently testable valve group subassembly so as to form a single unit;

the power group subassembly having a first connector portion and including:

an electromagnetic coil;

a housing surrounding at least a portion of the coil;

at least one terminal electrically coupled to the coil to supply electrical power to the coil; and at least one overmold formed over at least a portion of the coil and housing, the overmold having a first overmold end and a second overmold end opposite the first overmold end, the overmold defining an interior surface;

the valve group subassembly having a second connector portion and including:

a tube assembly having at least a portion engaged with the interior surface of the overmold, the tube assembly having an outer surface and a longitudinal axis extending between a first tube end and a second tube end, the tube assembly including:

an inlet tube having a first inlet tube end and a second inlet tube end;

a non-magnetic shell extending axially along the longitudinal axis and having a first shell end and a second shell end;

a pole piece having at least a first portion connected to the inlet tube and a second portion connected to the first shell end thereby coupling the first shell end to the inlet tube;

a valve body coupled to the second shell end; and an armature assembly disposed within the tube assembly substantially circumscribed by the electromagnetic coil, the armature assembly being displaceable along the longitudinal axis upon supplying energy to the electromagnetic coil, the armature assembly having a first armature end confronting the pole piece and a second armature end, the first armature end having a ferromagnetic portion and the second armature end having a sealing portion, the armature assembly further defining a through bore and at least one aperture in fluid communication with the through bore;

a member disposed and configured to apply a biasing force against the armature assembly toward the second tube end;

an adjusting tube disposed within the tube assembly proximate the second tube end;

a filter assembly having a filter element substantially disposed within the inlet tube such that at least a portion of the filter assembly engages the adjusting tube for adjusting the biasing force; and a seat assembly disposed in the tube assembly proximate the second tube end such that at least a portion of the seat assembly is disposed within the valve body, the seat assembly including:

a flow portion, the flow portion extending along the longitudinal axis between a first surface and a second surface at a first length, the flow portion having at least one orifice defining a central axis and through which fuel flows into the internal combustion engine; and a securement portion having an outer surface, the securement portion extending distally along the longitudinal axis from the second surface at a second length at least as long as the first length, the securement portion further having an attachment to the valve body within the second length.

2. The fuel injector of claim 1, wherein the inlet tube is formed integrally with the pole piece.

3. The fuel injector of claim 1, wherein the first portion of the pole piece is coupled to the inlet tube and the second portion of the pole piece is disposed inside the first shell end.

4. The fuel injector of claim 1, wherein the valve body defines an interior chamber and at least a portion of the second shell end is disposed in the chamber.

5. The fuel injector of claim 1, wherein the electromagnetic coil comprises a wire wound onto a bobbin, the bobbin circumscribing a portion of the first armature end.

6. The fuel injector of claim 1, wherein the valve body includes a first valve body end and a second valve body end, a retainer being circumscribed about the second valve body end and the first valve body end being coupled to the second shell end.

7. The fuel injector of claim 6, wherein the valve body further includes a groove and the retainer includes at least one finger-like portion for resilient locked engagement with the groove of the valve body.

8. The fuel injector of claim 6, wherein the retainer includes a dimpled portion to engage at least a portion of the seat assembly and a flared portion generally transverse to the longitudinal axis to support a sealing ring upon engagement with the valve body.

9. The fuel injector of claim 6, wherein the valve body defines a first wall thickness and the retainer defines a second wall thickness, the first wall thickness being at least twice the second wall thickness.

10. The fuel injector of claim 1, wherein the aperture of the armature assembly is substantially elongated in the direction of the longitudinal axis.

11. The fuel injector of claim 1, wherein the sealing portion of the second armature end includes a closure member having a generally spherical member with at least one flat face so as to define a two-piece armature assembly, the closure member being engaged with the first surface of the flow portion to prevent the flow of fuel through the orifice in a first position of the closure member, the closure member being spaced relative to the first surface to permit the flow of fuel through the orifice in a second position of the closure member.

12. The fuel injector of claim 11, wherein the armature assembly further comprises a lower armature guide disposed proximate the seat assembly, the lower armature guide being adapted to slidingly engage the closure member and center the armature assembly with respect to the longitudinal axis.

13. The fuel injector of claim 1, wherein the first armature end includes a first impact surface defining a first width, the first impact surface confronting the pole piece having a second impact surface defining a second width, the first width to the second width defining a ratio of about 0.85.

14. The fuel injector of claim 1, wherein the armature assembly includes a plurality of apertures formed on a surface of the armature assembly.

15. The fuel injector of claim 1, wherein the sealing portion of the second armature end includes a closure member having a spherical member including at least one flat face and engaged with the first surface of the flow portion to prevent the flow of fuel through the orifice in a first position of the closure member and spaced relative to the first surface to permit the flow of fuel through the orifice in a second position of the closure member; and the armature assembly includes a non-magnetic portion having a first end and a second end for coupling the second armature end to the closure member so as to define a three-piece armature assembly, the non-magnetic portion defining an interior chamber and the second end of the non-magnetic portion being joined to the closure member by at least one weld formed in the interior chamber.

16. The fuel injector of claim 15, wherein the non-magnetic portion comprises a deep drawn generally tubular member.

17. The fuel injector of claim 15, wherein the non-magnetic portion is formed by rolling a generally planar blank to form a seam, the seam being welded to form a tubular member.

18. The fuel injector of claim 15, wherein the at least one aperture of the armature assembly is located on the non-magnetic portion, and the at least one aperture is substantially elongated along the longitudinal axis.

19. The fuel injector of claim 1, wherein at least one of the second portion of the pole piece and the first end of the armature assembly has a surface extending generally obliquely with respect to the longitudinal axis.

20. The fuel injector of claim 19, wherein the at least one of the second portion of the pole piece and the first end of the armature assembly defines an oblique angle of about $2^N$ with respect to an axis extending orthogonal to the longitudinal axis.

21. The fuel injector of claim 1, wherein the at least one of the second portion of the pole piece and the first end of the armature assembly defines an arcuate surface.

22. The fuel injector of claim 1, wherein at least one of the second portion of the pole piece and the first end of the armature assembly comprises a surface treatment.

23. The fuel injector of claim 22, wherein the surface treatment comprises a surface treatment selected from a group consisting of a surface coating and case hardening and combinations thereof, the surface coating being selected from a group consisting of hard chromium plating, nickel plating, keronite plating and combinations thereof and the case hardening being selected from a group consisting of nitriding, carburizing, carbonitriding, cyaniding, heat, spark or induction hardening.

24. The fuel injector of claim 1, wherein the flow portion includes a sealing surface having at least a portion that is substantially concave about the longitudinal axis, the sealing surface surrounding the orifice.

25. The fuel injector of claim 24, wherein the sealing surface includes a finished surface.

26. The fuel injector of claim 1, wherein the at least one orifice defines a central axis generally parallel with the longitudinal axis.

27. The fuel injector of claim 1 wherein the seat assembly includes an orifice disk engaged with the flow portion to define the at least one orifice through which fuel flows, the seat assembly and orifice disk each being axially and rotatively fixed with respect to the valve body.

28. The fuel injector of claim 27, wherein at least a portion of the orifice disk is welded to the second surface of the flow portion to retain the orifice disc in a fixed orientation relative to the longitudinal axis.

29. The fuel injector of claim 27, further comprising at least one weld extending from the outer surface of the tube assembly to the outer surface of the securement portion at a location distal to the flow portion so that the seat assembly and the orifice disk generally maintain a fixed spatial orientation with respect to the flow portion.

30. The fuel injector of claim 1, wherein the flow portion is welded to at least a portion of the valve body.

31. The fuel injector of claim 1, wherein the second length of the securement portion is greater than the first length of the flow portion.

32. The fuel injector of claim 1, wherein the adjusting tube is axially fixed with respect to the inlet tube by an interference fit between a portion of the adjusting tube and a portion of the tube assembly.

33. The fuel injector of claim 1, wherein the attachment to the valve body in the securement portion is a weld.

34. The fuel injector of claim 33, wherein the weld circumscribes the longitudinal axis.

35. The fuel injector of claim 33, wherein the weld is at about 50% of the second length for the second surface.

36. The fuel injector of claim 33, wherein the weld is a continuous circumferential weld extending through the valve body and into the outer surface of the securement portion.

* * * * *